US005231708A

United States Patent [19]

Hansen

[11] Patent Number: 5,231,708

[45] Date of Patent: Aug. 3, 1993

[54] DISPOSABLE SHOWER CURTAIN

[76] Inventor: Eric R. Hansen, 16220 N. 7th St. #1055, Phoenix, Ariz. 85022

[21] Appl. No.: 775,433

[22] Filed: Oct. 15, 1991

[51] Int. Cl.[5] ..... A47K 3/14; E06B 9/56

[52] U.S. Cl. ..... 4/608; 4/610; 160/263; 160/291

[58] Field of Search ..... 4/557, 558, 607, 608, 4/609, 610; 160/23.1, 263, 291, 305, 323.1, 324, 326, DIG. 6; 242/55.2, 55.53

[56] References Cited

U.S. PATENT DOCUMENTS

| | | | |
|---|---|---|---|
| 305,370 | 9/1884 | Benedict | 160/263 X |
| 1,732,798 | 10/1929 | Falzer | 4/608 X |
| 1,881,037 | 10/1932 | Vuchetich | 160/263 |
| 2,465,853 | 3/1949 | Dalton, Jr. | 4/149 |
| 2,481,397 | 8/1949 | Dalton, Jr. | 4/608 X |
| 2,756,438 | 7/1956 | Soberman | 4/608 |
| 2,801,809 | 8/1957 | Glaner | 242/55.2 |
| 2,840,827 | 7/1958 | Calvano | 4/608 X |
| 3,222,689 | 12/1965 | Efron et al. | 4/608 |
| 3,719,220 | 3/1973 | Small | 160/324 X |
| 4,120,343 | 10/1978 | Wilson | 160/330 |
| 4,122,559 | 10/1978 | Kelly | 4/608 |
| 4,220,189 | 9/1980 | Marquez | 160/23.1 |
| 4,317,480 | 3/1982 | Phelps | 160/23.1 |
| 4,398,585 | 8/1983 | Marlow | 160/23.1 |
| 4,919,350 | 4/1990 | Miller | 242/55.2 |
| 5,033,132 | 7/1991 | Greenblatt | 4/610 X |
| 5,127,459 | 7/1992 | Markowitz | 160/263 |

FOREIGN PATENT DOCUMENTS

| | | | |
|---|---|---|---|
| 3507477 | 9/1986 | Fed. Rep. of Germany | 4/608 |
| 6413924 | 6/1965 | Netherlands | 4/608 |

*Primary Examiner*—William A. Cuchlinski, Jr.
*Assistant Examiner*—John L. Beres
*Attorney, Agent, or Firm*—Don J. Flickinger; Robert A. Parsons; Jordan M. Meschkow

[57] ABSTRACT

A disposable shower curtain including a holder having a mandrel with inner and outer telescoping segments normally expanded by a spring. Stationary feet, one carried by each of the telescoping segments, bears against the opposed walls of a conventional shower stall and rotatably support the mandrel. A roll of coiled sheet material is carried by the mandrel. A shield supported by a bracket at either end thereof includes a longitudinally extending braking panel.

8 Claims, 2 Drawing Sheets

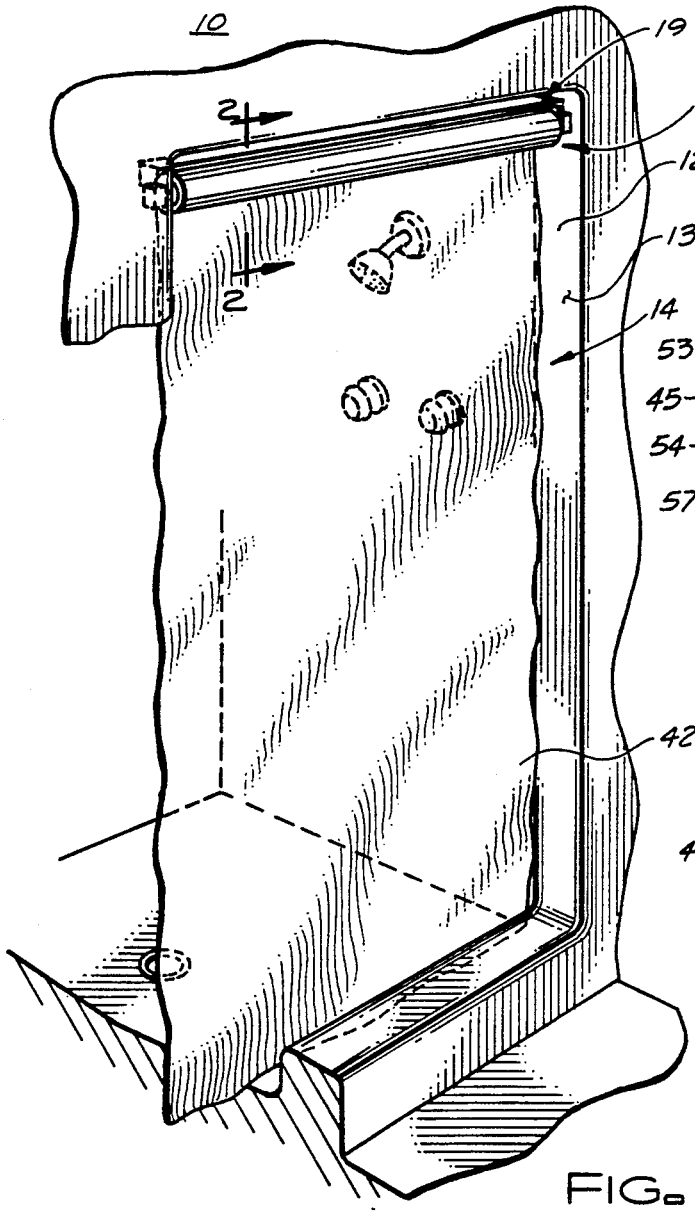
FIG. 1
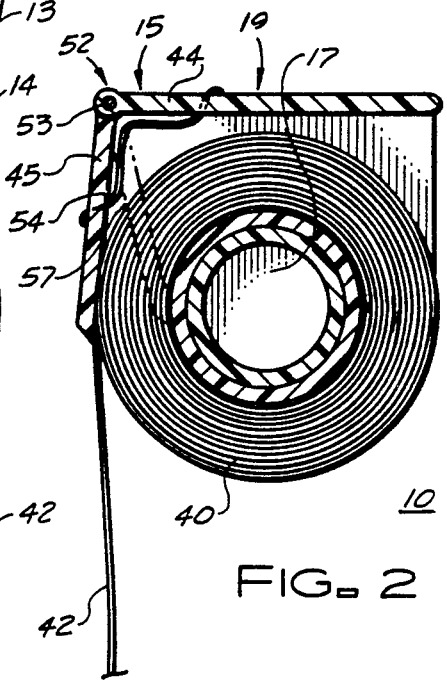
FIG. 2
FIG. 3
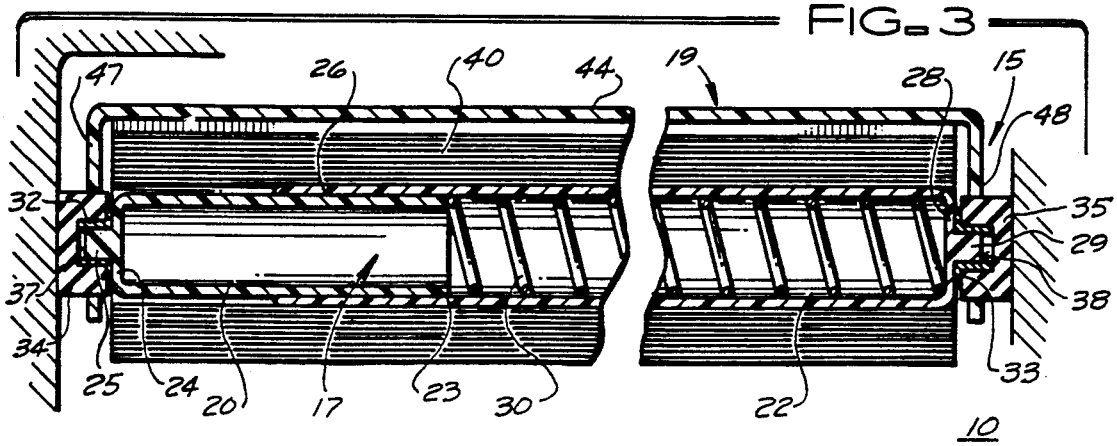

19
47
49
54
45
55
44
34
37
32
25
24
20
53
52
48
50
23
17
30
26
40
22
28
29
33
35
42
43
42

59
19
52
40
62
60
17

65
69
70
66
68
72
64

DISPOSABLE SHOWER CURTAIN

BACKGROUND OF THE INVENTION

1. Field of the Invention

This invention relates to the art of bath fixtures.

More particularly, the present invention relates to shower curtains for bathtubs and shower stalls.

2. Prior Art

Devices to prevent the escape of water when taking a shower are well-known in the art. The most common devices are shower curtains or doors. Shower curtains usually employ a rod which extends across the open side of the tub or shower stall. A curtain of plastic or cloth then extends downward from the shower rod and can be opened or closed by sliding the curtain along the rod. While shower curtains are simple to install, they can be expensive, and require upkeep such as drying before they are allowed to remain open. Also, sanitation may be a problem since, if opened while wet, mold may grow between the folds which have not been allowed to dry properly. Also, if not frequently cleaned, shower curtains collect soap deposits, dust and other unsanitary material.

Shower doors are frequently used, and consist of a ridged frame with a glass or plastic material as a panel. The door panel may slide or swing shut, and is frequently constructed of clear material While very effective for preventing the escape of water, shower doors tend to be expensive and often are very difficult to install. Shower doors must also be cleaned frequently to remove soap deposits, dust and other unsanitary material Also, shower doors do not tend to fit all sizes. A shower door must have the same dimensions as the area enclosed, or a great deal of modification will be required, adding to expense and difficulty in installation.

It would be highly advantageous, therefore, to remedy the foregoing and other deficiencies inherent in the prior art.

Accordingly, it is an object of the present invention to provide a new and improved shower curtain.

Another object of the present invention is to provide a shower curtain device which is easily and cheaply installed.

And another object of the present invention is to provide a shower curtain which is disposable.

Still another object of the present invention is to provide a disposable shower curtain which is relatively inexpensive.

Still another object of the present invention is to provide a shower curtain which is sanitary and need not be cleaned.

Yet still another object of the present invention is to provide a disposable shower curtain which is biodegradable.

A further object of the instant invention is to provide a shower curtain device which will fit substantially all size openings.

Yet a further object of the present invention is to provide a shower curtain device which is easily used.

SUMMARY OF THE INVENTION

Briefly, to achieve the desired objects of the invention in accordance with the preferred embodiment thereof, provided is a holder having a mandrel with inner and outer telescoping segments normally expanded by a spring. Stationary feet, one carried by each of the telescoping segments, and bearing against the opposing walls of a conventional shower stall, are coupled to the mandrel. The stationary feet rotatably support the mandrel. A roll of coiled sheet material periodically perforated along a lateral line is carried by the mandrel. A stationary shield is supported over the mandrel and includes a hingedly affixed panel to act as a friction brake against the roll.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of the disposable shower curtain, constructed in accordance with the teachings of the instant invention, as it would appear installed on a conventional shower stall;

FIG. 2 is a cross-sectional side view of the disposable shower curtain of FIG. 1 taken along line 2;

FIG. 3 is a cross-sectional front view of the disposable shower curtain;

DESCRIPTION OF THE PREFERRED EMBODIMENT

Figures 4, 5, 6:
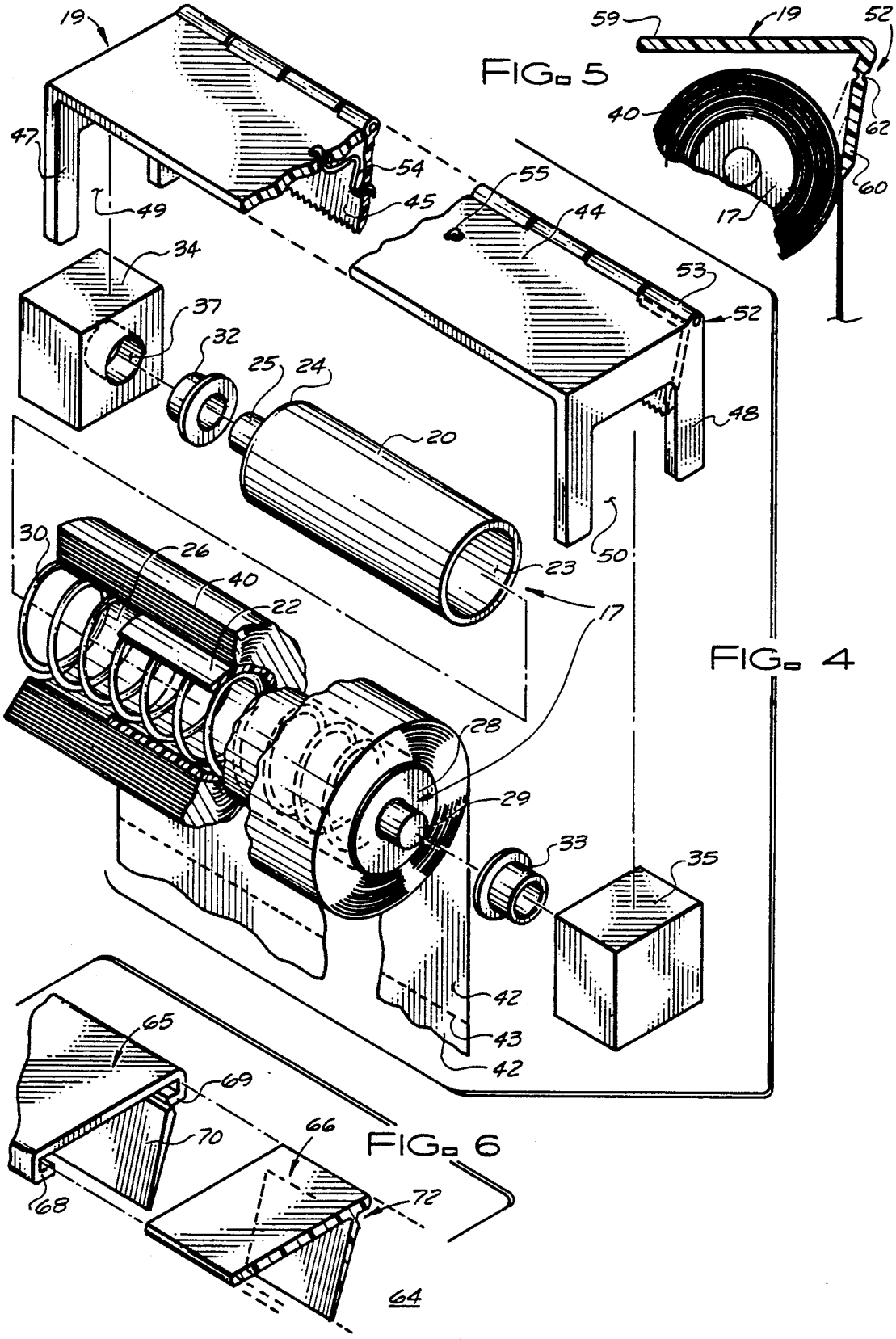
FIG. 4 is a fragmentary perspective view of the disposable shower curtain.
FIG. 5 is a cross-sectional side view illustrating an alternate embodiment to the braking panel.
FIG. 6 is a partial perspective view of a telescoping shield.

Turning now to the drawings in which like reference characters indicate corresponding elements throughout the several views, attention is first directed to FIG. 1 which illustrates a disposable shower curtain, generally designated 10, installed between walls 12 which define opening 13 of a shower stall 14. Those skilled in the art will understand that while disposable shower curtain 10 is illustrated being used in shower stall 14, disposable shower curtain 10 may be used on any shower that has two opposing surfaces to which disposable shower curtain can be attached.

Referring now to FIG. 4, disposable shower curtain 10 includes a holder 15 having a mandrel 17, attachment members for attaching holder 15 to walls 12, and a shield 19. Mandrel 17 consists of two generally cylindrical telescoping segments 20 and 22. Segment 20 has an open end 23 and a closed end 24 from which a knob 25 extends. Segment 20 is slightly smaller than segment 22 permitting its insertion into an open end 26 of segment 22. Opposite open end 26 of segment 22 is closed end 28 with a knob 29 extending therefrom. A mandrel spring 30 is located inside segment 22, and compressed between open end 23 of segment 20 and closed end 28 of segment 22. Knobs 25 and 29 extend outward in opposite directions, on the same axis, and each fit into cylindrical bushing bearings 32 and 33 respectively. The attachment members, in this embodiment, consist of feet 34 and 35, which are substantially square blocks of friction material such as plastic. Feet 34 and 35 each have a bushing opening 37 and 38 sized to receive bushing bearings 32 and 33. Bushing bearings 32 and 33 are securely held by the friction material of feet 34 and 35, while allowing mandrel 17 to turn freely.

Still referring to FIG. 4, a roll 40 of shower curtain material is supported by mandrel 17. Roll 40 is composed of a plurality of sheets 42 of shower curtain material separated by lateral perforations 43 at regular intervals. As illustrated in FIG. 1, each sheet 42 is large enough to cover opening 13 of shower stall 14. After a sheet 42 has been used, it is removed along perforations 43. The next sheet 42 can then be unrolled when needed. Those skilled in the art will understand that while any flexible lightweight material may be used for sheets 42, a biodegradable material is preferred such as paper sheets.

Also included in disposable shower curtain 10 illustrated in FIG. 4, is a shield 19. Shield 19 consists of a substantially rectangular planar surface 44 and a braking panel 45 coupled perpendicularly thereto. Brackets 47 and 48 extend perpendicularly from opposite ends of planar surface 44. Brackets 47 and 48 are each formed with a notch 49 and 50 configured to receive feet 34 and 35. Braking panel 45 is coupled to planar surface 44 by a biasing means 52. In the preferred embodiment, biasing means 52 consists of a hinge 53 coupling braking panel 45 to planar surface 44, and biasing springs 54 and 55 extending from the bottom of planar surface 44 and coupled to braking panel 45.

Referring now to FIG. 2, it can be seen that braking panel 45 would be biased inward by biasing springs 44 and 45, corresponding to dotted line 57. However, roll 40, when in place, forces braking panel 45 outward against the tension of biasing springs 54 and 55. The tension from biasing springs 54 and 55 causes braking panel 45 to press against roll 40. This prevents roll 40 from turning on mandrel 17 unless a positive force is applied to extract sheet 42. Thus, once sheet 42 is unrolled and hanging in place, braking panel 45 presses against roll 40 preventing further turning of mandrel 17 by friction.

FIG. 5 illustrates an alternate embodiment of biasing means 52 on shield 19. In this embodiment, a planar surface 59 is formed with an integral braking panel 60 extending downward therefrom in an inward direction. Spring grooves 62 are formed extending laterally across braking panel 60 where it joins planar surface 59. Spring grooves 62 allow braking panel 60 to be forced outward by roll 40. The flexibility of the material allows this outward flex under tension. The tension causes braking panel 60 to press inward, forming a friction brake against roll 40.

FIG. 6 illustrates a shield with a biasing means 52 similar to that illustrated in FIG. 5. However, in this embodiment, shield 64 is formed with two telescoping segments 65 and 66. Segment 65 of shield 64 has lips 68 and 69 formed by folding its edges under. Braking panel 70 extends downward from lip 69 by biasing means 72. The telescoping ability of shield 64 allows its width to be varied corresponding to the width of telescoping mandrel 17.

FIG. 3 illustrates disposable shower curtain 10 installed between walls 12. Segment 20 is forced into segment 22 compressing mandrel spring 30 of telescoping mandrel 17. This allows mandrel 17 to fit between walls 12. Feet 34 and 35 are placed flush with walls 12, and mandrel 17 is allowed to expand so that knob 25 and knob 29 are received by bushing bearings 32 and 33 respectively. The tension from mandrel spring 30 forces segments 20 and 22 apart and forcing feet 34 and 35 against walls 12. This provides a sufficient friction between feet 34 and 35 and walls 12, to hold disposable shower curtain 10 securely in place. Roll 40 surrounds mandrel 17, and is protected from moisture and shower water by shield 19. Brackets 47 and 48 of shield 19 fit over feet 34 and 35 respectively. Since feet 34 and 35 do not rotate with mandrel 17, shield 19 is held stationary.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A disposable shower curtain device comprising:
a rotatable mandrel having;
a first substantially cylindrical segment,
a second substantially cylindrical segment configured to receive said first segment, and
a mandrel spring received by said second segment and normally expanding said first segment therefrom,
stationary feet;
a bushing opening in each of said stationary feet;
bushing bearings, one received by each of said bushing openings;
a knob extending from each end of said mandrel and received by a bushing bearing;
a roll of coiled sheet material supported by said mandrel; and
a shield having;
a planar panel,
a bracket extending perpendicularly downward from each end of said planar panel,
a braking panel depending from an edge of said planar panel, between said brackets,
a longitudinally extending hinge coupling said braking panel to said planar panel, and
biasing means for biasing said braking panel in relation to said planar panel.

2. A device as claimed in claim 1 wherein said brackets are configured to engage said feet.

3. A device as claimed in claim 1 wherein said biasing means is at least one spring extending from the bottom of said planar surface, and coupled to said braking panel.

4. A device as claimed in claim 1 wherein sheets on said roll of material are defined and separable by longitudinal perforations.

5. A device as claimed in claim 4 wherein said material is paper toweling.

6. A disposable shower curtain device comprising:
a rotatable mandrel having;
a first substantially cylindrical segment,
a second substantially cylindrical segment configured to receive said first segment, and
a mandrel spring received by said second segment, and normally expanding said first segment therefrom,
a knob extending from each end of said mandrel;
stationary feet, each having a bushing opening;
bushing bearings, one received by each of said bushing openings;
each of said knobs received by a bushing bearing;
a roll of coiled sheet material supported by said mandrel; and
a shield having;
a planar panel, a bracket extending perpendicularly downward from each end of said planar panel coupling said shield to said mandrel, a braking panel depending from an edge of said planar panel, between said brackets, a longitudinally extending hinge coupling said braking panel to said planar panel, and biasing means for biasing said braking panel in relation to said planar panel.

7. A device as claimed in claim 6 wherein said brackets are configured to engage said feet.

8. A device as claimed in claim 6 wherein said biasing means is at least one spring extending from the bottom of said planar surface, and coupled to said braking panel.

* * * * *